US006763991B2

(12) United States Patent
Hamano

(10) Patent No.: US 6,763,991 B2
(45) Date of Patent: Jul. 20, 2004

(54) FEEDING MECHANISM FOR CONNECTED NAILS IN NAILING MACHINE

(75) Inventor: Terufumi Hamano, Tokyo (JP)

(73) Assignee: Max Co., Ltd., Tokyo (JP)

( * ) Notice: Subject to any disclaimer, the term of this patent is extended or adjusted under 35 U.S.C. 154(b) by 0 days.

(21) Appl. No.: 10/073,355

(22) Filed: Feb. 13, 2002

(65) Prior Publication Data

US 2002/0113114 A1 Aug. 22, 2002

(30) Foreign Application Priority Data

Feb. 15, 2001 (JP) ..... P2001-039265

(51) Int. Cl.[7] ..... B25C 5/02
(52) U.S. Cl. ..... 227/135; 227/119; 227/136
(58) Field of Search ..... 227/135, 119, 227/136

(56) References Cited

U.S. PATENT DOCUMENTS 5,240,161 A * 8/1993 Kaneko ..... 227/109
5,738,266 A * 4/1998 Ogawa ..... 227/128
5,772,098 A * 6/1998 Crutcher ..... 227/119
5,803,338 A * 9/1998 Singer et al. ..... 227/8
5,842,625 A * 12/1998 Kimura ..... 227/127
6,006,975 A 12/1999 Ishizawa

FOREIGN PATENT DOCUMENTS

EP 0 369 587 5/1990

* cited by examiner

*Primary Examiner*—Stephen F. Gerrity
*Assistant Examiner*—Brian D Nash
(74) *Attorney, Agent, or Firm*—Morgan, Lewis & Bockius LLP

(57) ABSTRACT

In a nailing machine capable of feeding not only wire-connected nails but also nails connected by a plastic sheet into the nail ejecting opening of a nose portion, the nail shank of one of the wire-connected nails is supplied with shifting the nail shank toward the welded portion of the wire-connected nail with respect to the center of the nail ejecting opening. Further, depressions for containing cutoff pieces of the wire-connected nails are formed in the shifted side of the nail shank, and discharging opening for sheet leaves of the nails connected by the plastic sheet is shifted so that the front end of a driver is prevented from hammering the connecting sheet leaf by guiding the connecting sheet leaf in a direction opposite to the direction of shifting the nail shank of the wire-connected nail.

2 Claims, 8 Drawing Sheets

FEEDING MECHANISM FOR CONNECTED NAILS IN NAILING MACHINE

BACKGROUND OF THE INVENTION

1. Field of the Invention

The present invention relates to a nailing machine, in which connected nails are successively fed into an ejecting portion and the nail supplied into the ejecting portion is hammered by utilizing the power of compressed air after breaking the nail-to-nail connected condition. More specifically, the present invention relates to a nailing machine for both types of connected nails including the nails connected together by a metal wire and the nails connected by plastic sheets that are respectively formed into holding leaves by holding down both sides of the plastic sheets in order to hold and connect the nails.

2. Description of the Related Art

As connected nails for use in nailing machines driven by compressed air, there are known types of connected nails including wire-connected nails prepared by welding (fusion-bonding) a metal wire to nail shanks for the connecting purpose and nails connected by a plastic sheet prepared by forming a pair of bendable holding leaves integrally on both sides of the continuous plastic connecting sheet and inserting the nail shanks into the respective holding leaves for the connecting purpose. These types of connected nails are employed in different ways depending on the jobsite, and not only nailing machines capable of using both types of connected nails but also those adapted for alternately using both types of them have already been developed.

FIG. 6 shows the nail ejecting portion of a nailing machine for use in both types mentioned above. In a nose portion 20 provided in the lower portion of a nailing machine body, a nail ejecting opening 22 is formed for slidably guiding a driver 21 driven by a cylinder piston mechanism disposed within the body. An opening for introducing the front nail out of the connected nails in the nail ejecting opening 22 is formed in the nail ejecting opening 22. As shown in FIGS. 7(*a*) and 7(*b*), a nail feeding passage 25 is formed between a fixed guide wall 23 that is continuous to one side edge of the opening and used to guide the connected nails up to the nail ejecting opening 22 and a door member 24 that is openable with respect to the nose portion 20 and supported opposite to the fixed guide wall 23. A pressing plate 26 resiliently urged toward the fixed guide wall 23 is placed for the door member 24 whereby to maintain the space of the passage 25 for feeding wire-connected nails A and also to press nails B connected by a plastic sheet against the fixed guide wall 23. The nail feeding passage 25 is disposed on the line prolonged from the center line of the nail ejecting opening 22 so as to arrange each of the connected nails in the center of the nail ejecting opening 22.

When the front nail is hammered by the driver 21 in a case where the wire-connected nails A are used, a connecting wire 30 between the front nail 31 and the second nail 32 is cut, and the front nail 31 is hammered out of the nail ejecting opening 22 as the connected condition is removed. At this time, a cutoff piece 30*a* of the connecting wire 30 is formed on the front side of the shank of the second nail 32. Since the cutoff piece 30*a* is usually formed in the direction of the tip of the nail (downward) as shown in FIG. 6, it is hardly allowed to penetrate into a workpiece along the shank of the hammered nail. For this reason, the tip of the cutoff piece 30*a* comes into contact with the surface of the workpiece when the nail is hammered into the workpiece, and the cutoff piece 30*a* may be curved and separated from the wire-welded portion of the shank of the nail. This is dangerous because the cutoff pieces 30*a* may possibly fly in all directions.

In order to prevent the cut-pieces 30*a* from flying in all directions, depressions 27 for containing the front portions of the cutoff pieces 30*a* of the wire 30 are formed in the nail ejecting opening 22 of the nose portion 20 as shown in FIG. 6, so that each cutoff piece 30*a* attached to the shank of the hammered nail is formed upward. Since the tip of the cutoff piece 30*a* of the wire is received by the depression 27 when the nail is sent to the nose portion 20, the cutoff piece 30*a* is mated with the depression 27. Then the cutoff piece 30*a* is moved together with the shank portion of the nail when the nail is hammered out. Therefore, the cutoff piece 30*a* is directed upward and prevented from jumping up and down.

However, the depressions 27 for containing the front portions of the cutoff pieces 30*a* of the wire 30 are formed on the front side of the nail ejecting opening 22 of the nose portion 20 in the conventional art. Therefore, the tip of the cutoff piece 30*a* of the wire 30 may not be contained in the depression 27. This may happen in a case where the length of the cutoff piece 30*a* formed in front of the shank of the nail is short when connected nails have narrow connecting intervals or where the form of the cutoff piece 30*a* of the wire 30 becomes unstable. With respect to a special nailing machine for wire-connected nails A, the following technique has already been proposed as shown in FIG. 7(*a*): the depressions 27 formed in the nail ejecting opening 22 are formed in the side of the direction of supply to ensure that the cutoff pieces 30*a* are mated with the depressions 27 by eliminating the nonconformity stated above; moreover, the nails are supplied by shifting (offsetting) the nail feeding position in the direction in which the depressions 27 are formed to ensure that the cutoff pieces 30*a* are prevented from flying in all directions by allowing even the short cutoff pieces 30*a* to be contained in the depressions 27.

However, the introduction of the above technique into a nailing machine for use in both types results in placing a connecting sheet leaf 29 of the nail B connected by the plastic sheet closer to the center of the nail ejecting opening 22. Accordingly, the shoulder portion 29*a* of the connecting sheet leaf 29 is hammered by the driver 21 when the nail 31 is hammered as shown in FIG. 8. Consequently, the nail ejecting opening 22 may be clogged with the nail because the connecting sheet leaf 29 is crushed, and the supply of the nails B connected by the plastic sheet may also be impeded by the hammering trouble.

SUMMARY OF THE INVENTION

An object of the present invention is to provide a feeding mechanism for connected nails in a nailing machine for simultaneous use in hammering wire-connected nails A and nails B connected by a plastic sheet, wherein cutoff pieces of a wire can be effectively prevented from flying in all directions and wherein nails connected by the plastic sheet can also be supplied and hammered into a workpiece without impediments.

In order to solve the foregoing problems, there is provided a feeding mechanism for connected nails in a nailing machine capable of feeding not only wire-connected nails prepared by fusion-bonding a metal wire to the nail shanks but also nails connected by a long plastic sheet into the nail ejecting opening of a nose portion. The nails connected by the plastic sheet are prepared by inserting the nail shanks into the respective holding leaves formed along the extended direction of the plastic sheet. The wire-connected nail is supplied by offsetting the nail shank toward the wire-bonded portion of the wire-connected nail with respect to the center of the nail ejecting opening, and depressions for containing cutoff pieces of the wire-connected nails are formed in the offset side of the nail shank in the nail ejecting opening. A discharging opening for sheet leaves of the nails connected by the plastic sheet is offset so that the front end of a driver is prevented from hammering the connecting sheet leaf of the nail connected by the plastic sheet by guiding the connecting sheet leaf in a direction opposite to the direction of offsetting the shank of the wire-connected nail.

DETAILED DESCRIPTION OF THE PREFERRED EMBODIMENTS

Figure 1:
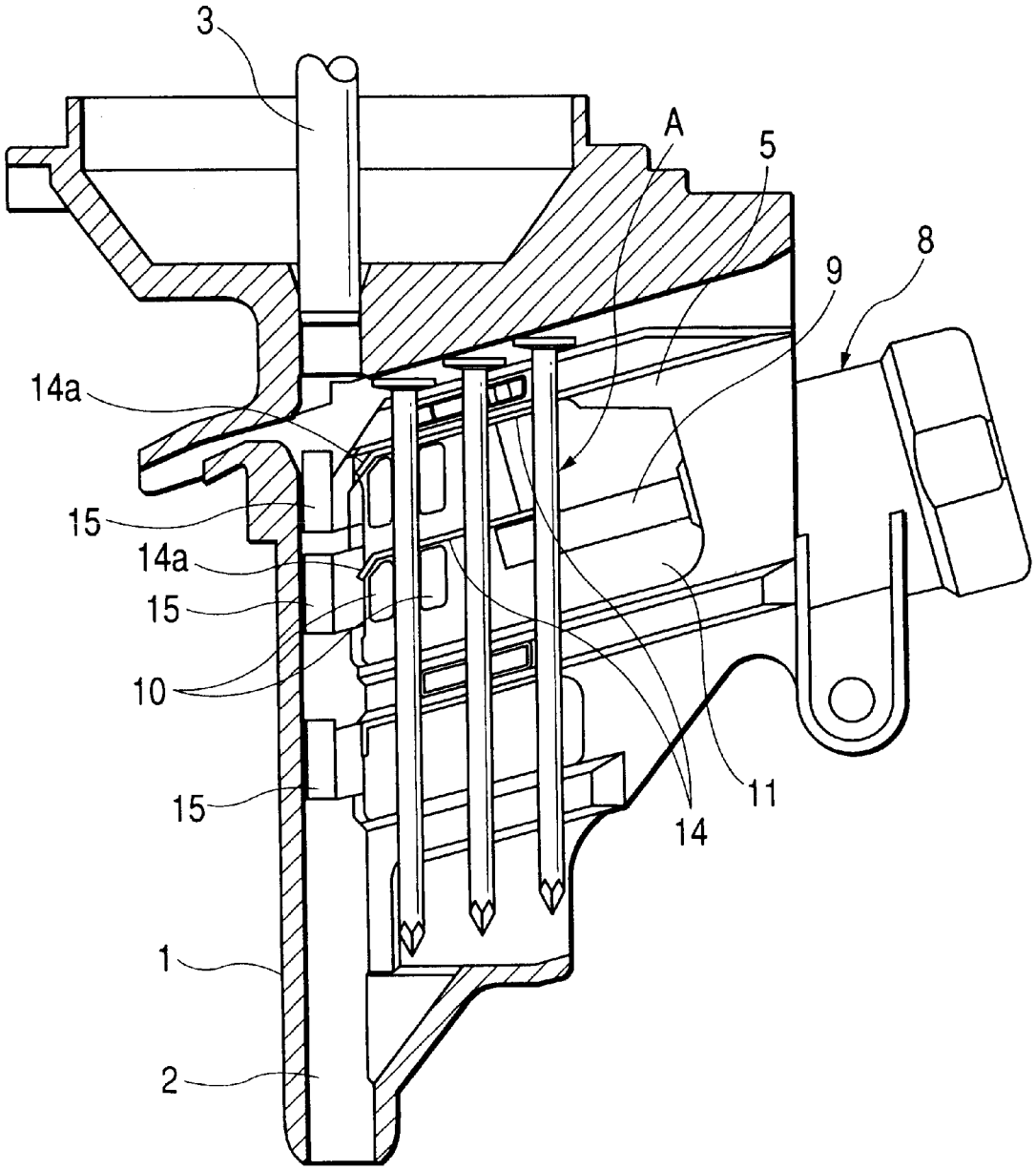
FIG. 1 is a vertical sectional view of a nose portion loaded with wire-connected nails according to an embodiment of the present invention.
Figure 2:
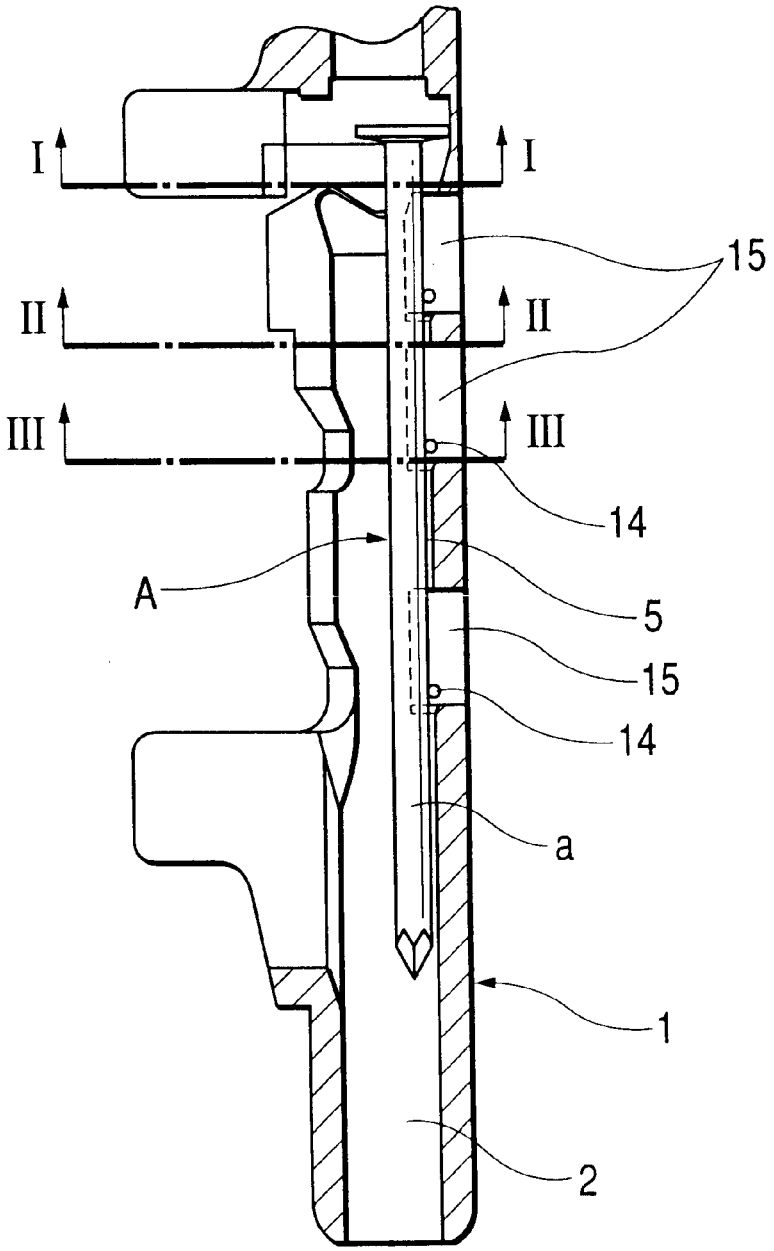
FIG. 2 is a sectional view of the nose portion of FIG. 1.
Figure 3A:
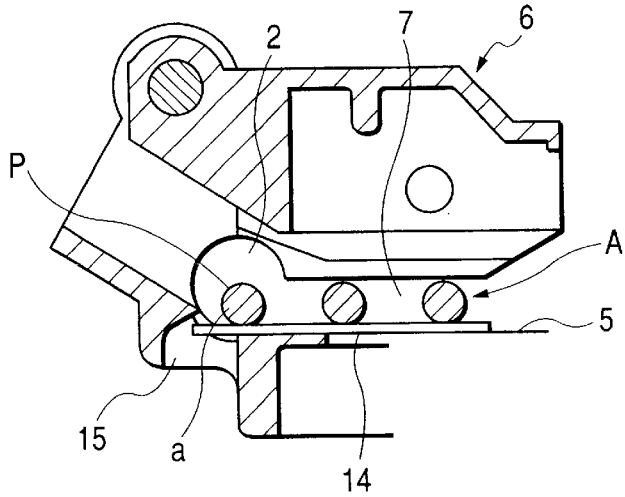
FIGS. 3(*a*), 3(*b*) and 3(*c*) are sectional views taken along the lines I—I, II—II and III—III of FIG. 2, respectively.
Figure 3B:
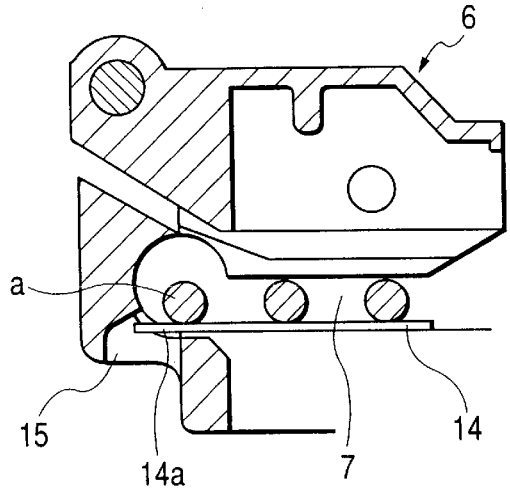
Figure 3C:
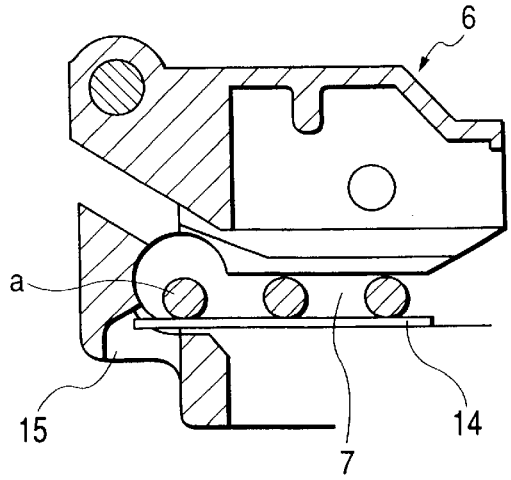

An embodiment of the present invention will now be described with reference to the drawings. FIG. 1 is a vertical sectional view of the nose portion of a nailing machine embodying the invention. FIG. 2 is a sectional view of the nose portion. FIG. 3(*a*) is a sectional view taken along the line I—I of FIG. 2; FIG. 3(*b*) is a sectional view taken along the line II—II thereof; and FIG. 3(*c*) is a sectional view taken along the line III—III thereof.

A nose portion 1 is provided in the lower end portion of the housing of a nailing machine body and forms a hollow nail ejecting opening 2 for ejecting nails. A driver 3 is integrally mounted on a piston to be driven under the impact of compressed air in a cylinder provided in the housing and is slidably guided in the nail ejecting opening 2. An opening for receiving one of the connected nails is formed in one side of the nail ejecting opening 2. A nail feeding passage 7 is for guiding the connected nails up to the nail ejecting opening 2. The nail feeding passage 7 is formed with a fixed guide wall 5 adjoining the one side of the opening and extending backward and an openable door member 6 pivotally supported on the opposite side of the fixed guide wall 5.

A nail feeding mechanism 8 constituted by a feed piston and a piston-cylinder mechanism for containing the feed piston is disposed on the back side of the fixed guide wall 5. The feed piston is slidable along the nail feeding passage 7 and nail feeding pawls 10 are attached to the front end of a piston rod 9. The nail feeding pawls 10 are projected into the nail feeding passage 7 via a window hole 11 formed in the fixed guide wall 5 and reciprocated along the nail feeding passage 7. The reciprocating nail feeding pawls 10 clamp the shank of one of the wire-connected nails A in the nail feeding passage 7 whereby to feed the nail into the nail ejecting opening 2. Moreover, the fixed guide wall 5 is provided with check pawls (not shown) capable of projecting into the nail feeding passage 7, so that the wire-connected nails A are prevented from moving back when the nail feeding pawls 10 are retracted.

The fixed guide wall 5 for guiding the nail shank a is shifted (offset) toward the welded (fusion-bonded) wire 14 of the wire-connected nails A with respect to the center P of the nail ejecting opening 2. Further, depressions 15 are formed for containing cutoff pieces 14*a* formed in front of the shank a of the front nail of the wire-connected nails A. The depressions 15 are shifted toward the side on which the fixed guide wall 5 is formed, and the fixed guide wall 5 communicating with the opening and one side of the opening is disposed substantially tangential to the depressions 15 of the nail ejecting opening 2. Thus, each of the wire-connected nails A is supplied while the nail is shifted toward the side on which the depressions 15 are formed in the nail ejecting opening 2. Since the nail shank a placed in the nail ejecting opening 2 is set close to the depressions 15 for containing cutoff pieces 14*a*, it is ensured that the cutoff pieces 14*a* of the connecting wire are contained in the depressions 15 even though the cutoff pieces 14*a* are short.

Figure 4:
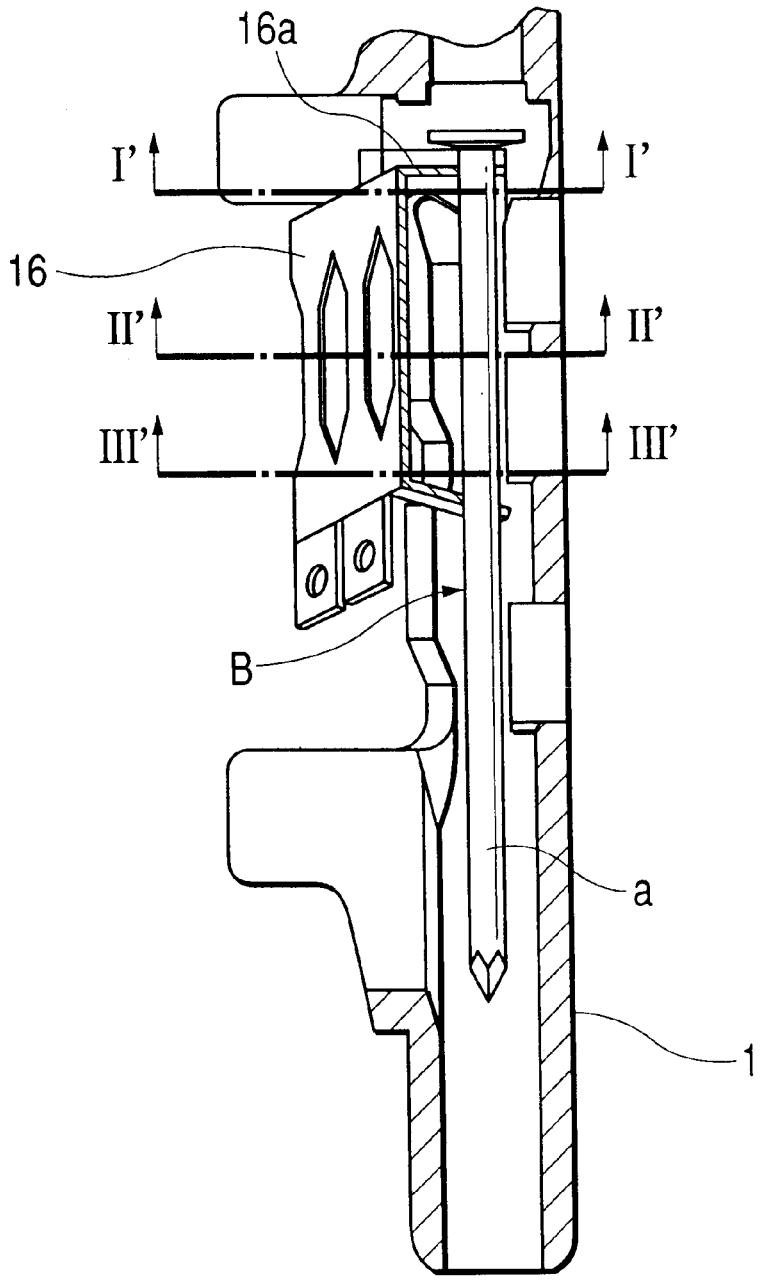
FIG. 4 is a vertical rear elevation of a nose portion loaded with nails connected by a plastic sheet as in FIG. 2.
Figure 5A:
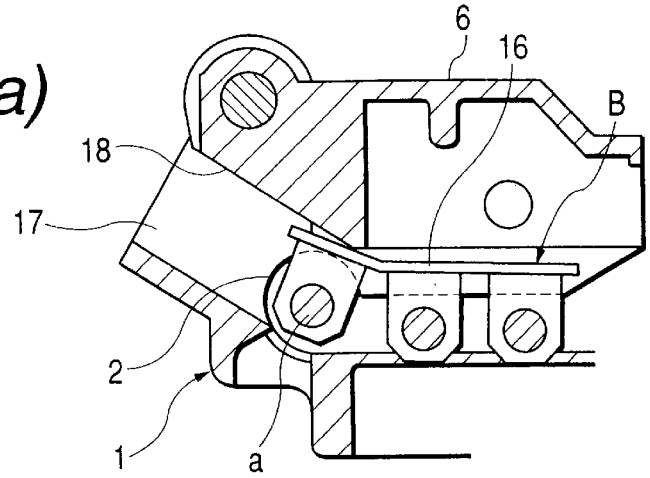
FIGS. 5(*a*), 5(*b*) and 5(*c*) are sectional views taken along the lines I'—I', II'—II' and III'—III' of FIG. 4, respectively.
Figure 5B:
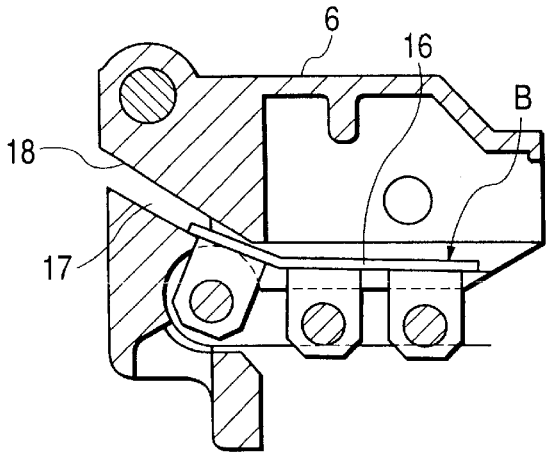
Figure 5C:
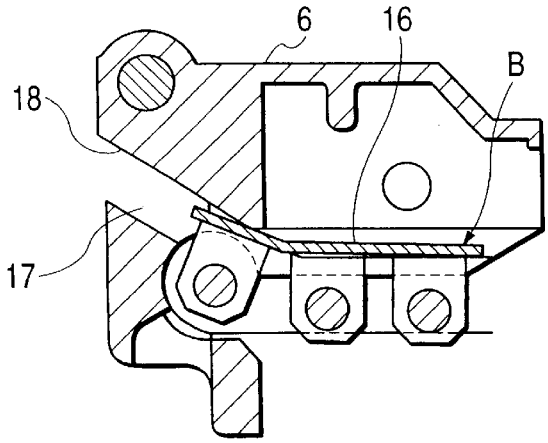
Figure 6:
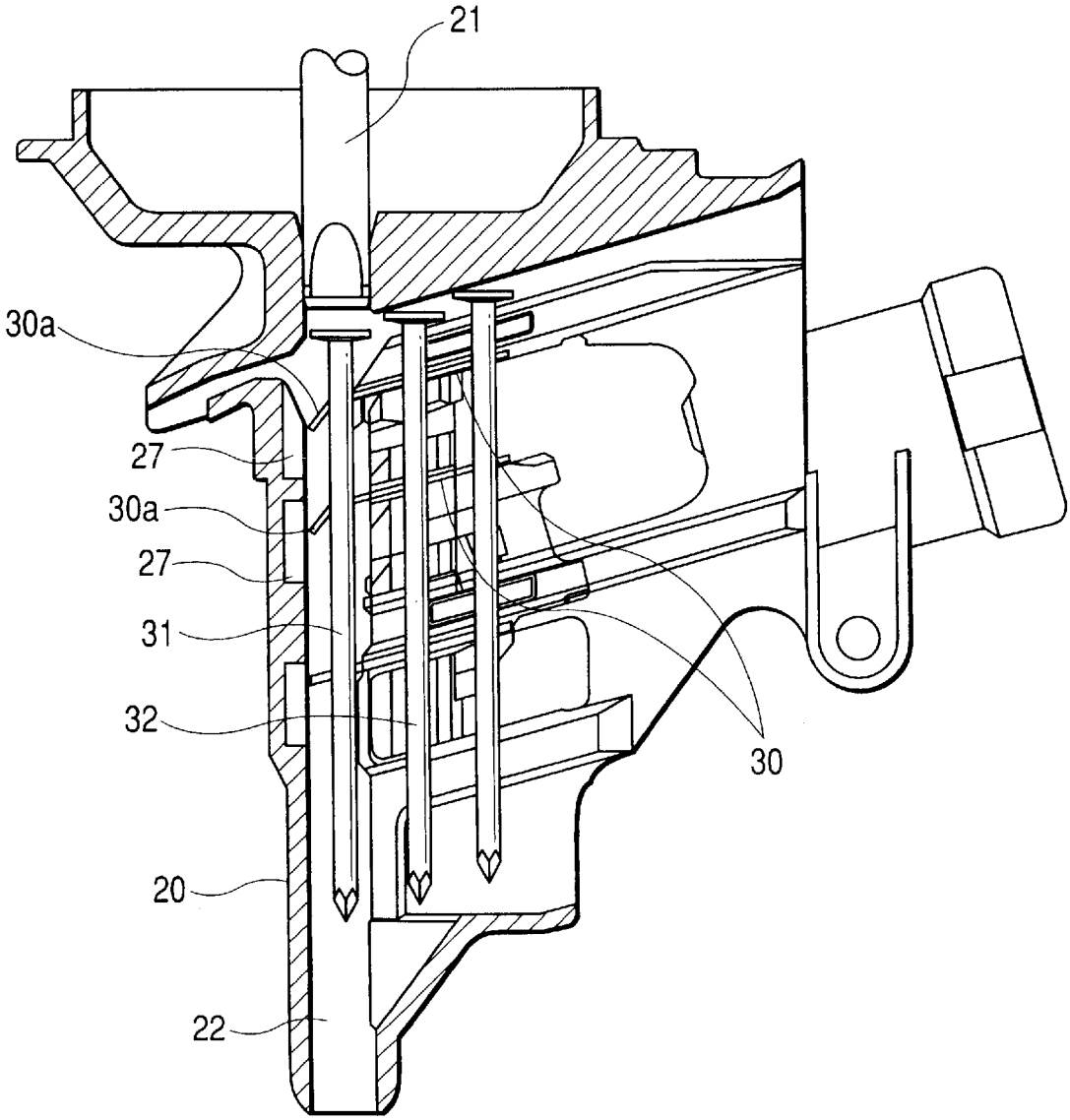
FIG. 6 PRIOR ART
FIG. 6 is a vertical side view of a nose portion in a conventional nailing machine.
Figure 7A:
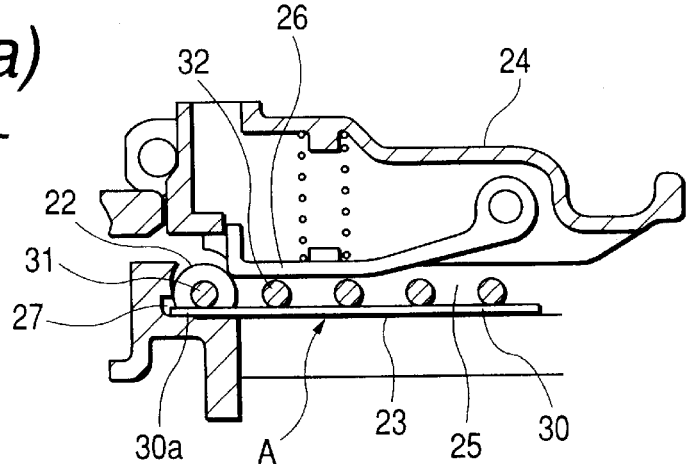
FIG. 7(a) PRIOR ART
FIGS. 7(*a*) and 7(*b*) are horizontal sectional views of the nose portions loaded with wire-connected nails and nails connected by a plastic sheet, respectively.
Figure 7B:
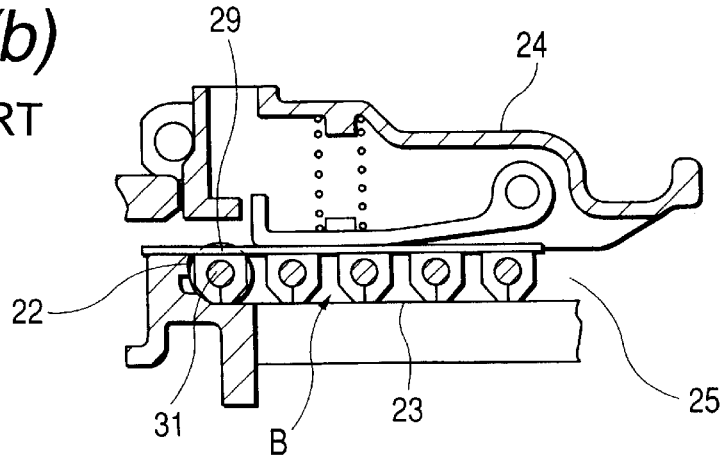
FIG. 7(b) PRIOR ART
Figure 8:
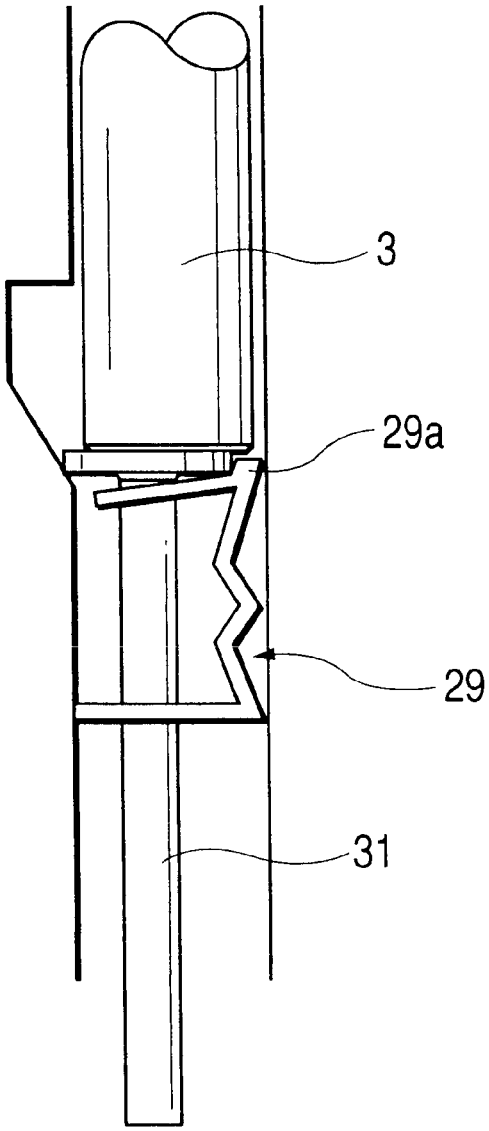
FIG. 8 PRIOR ART
FIG. 8 is a sectional view showing a condition in which the shoulder portion of a plastic sheet has been hammered.

Further, as shown in FIGS. 4, 5(*a*), 5(*b*) and 5(*c*), a discharge opening 17 for discharging the empty connecting sheet leaves 16 of nails B connected by a plastic sheet is formed in front of the nail ejecting opening 2. The discharge opening 17 is constituted by the nose portion 1, which forms the nail ejecting opening 2, and a guiding surface 18 formed on the door member 6. The guiding surface 18 on the side of the nose portion 1 is tilted with respect to the nail ejecting opening 2 so that the connecting sheet leaf 16 is guided in a direction opposite to the direction in which the nail shank a is shifted. When the nails B connected by the plastic sheet are used, the connecting sheet leaf 16 is guided by the guiding surface 18 formed on the nose portion 1 in the direction tilted with respect to the nail feeding direction, and then the connecting sheet leaf 16 is discharged therefrom. With respect to the nail placed in the nail ejecting opening 2 from the nails B connected by the plastic sheet, the back portion of the connecting sheet leaf 16 holding the nail mates with the guiding surface 18 and is deviated from the fixed guide wall 5. Accordingly, the nail shank a is disposed in the substantially center of the nail ejecting opening 2. Since the shoulder portion 16*a* of the connecting sheet leaf 16 holding the nail shank a placed in the nail ejecting opening 2 is shifted outside the sliding range of the driver 3, the front end of the driver 3 is effectively prevented from hammering the shoulder portion of the connecting sheet leaf 16.

In the nailing machine described above, the depressions 15 of the nail ejecting opening 2 are formed on the shifted side of the nail shank a to ensure that the cutoff pieces 14*a* of the wire of the wire-connected nails A are contained therein and also prevented from flying in all directions even though the nail-to-nail interval of the wire-connected nails is narrow or the form of the cutoff piece of the wire becomes unstable. Moreover, the discharging opening 17 for the leaves of a connecting sheet is formed for the nails B connected by the plastic sheet so that the connecting sheet leaf 16 is guided in the direction opposite to the direction of shifting the shank a of the wire-connected nail A. As a result, the front end of the driver 3 is effectively prevented from hammering the connecting sheet leaf 16 when the nail is hammered out. Therefore, according to the above feeding mechanism for connected nails, the cutoff pieces 14*a* of the wire can be effectively prevented from flying in all directions, and the nails B connected by the plastic sheet can also be supplied and hammered into a workpiece without impediments.

What is claimed is:

1. A feeding mechanism for connected nails in a nailing machine capable of feeding both wire-connected nails prepared by welding a metal wire to nail shanks and nails connected by plastic sheet leaves into a nail eject opening of a nose portion of the nailing machine, the nails connected by the plastic sheet leaves being prepared by inserting the nail shanks into respective leaves formed along a direction of the connected nails in the plastic sheet leaves, wherein each wire-connected nail is offset, with respect to a center of the nail eject opening, toward a fixed guide wall, and depressions for containing cutoff pieces of the wire-connected nails are formed in the nail eject opening adjacent to the fixed guide wall, and wherein a discharge opening for plastic sheet leaves is adjacent to the eject opening and at an acute angle to a line alone the direction of the connected nails substantially tangential with the surface of the fixed guide wall so that a front end of a driver is prevented from hammering the plastic sheet leaves by guiding the plastic sheet leaves in a direction of the discharge opening.

2. A feeding mechanism for connected nails in a nailing machine capable of feeding both wire-connected nails and nails connected by sheet leaves into a nail eject opening of a nose portion of the nail machine, wherein the wire-connected nails are prepared by welding a metal wire to nail shanks, and the nails connected by sheet leaves are prepared by inserting nail shanks into respective leaves formed along a direction of the sheet leaves, said feeding mechanism comprising:

a depression for containing a cutoff piece of each wire-connected nail, formed in a fixed guide wall side of the nail eject opening; and a discharge opening for the sheet leaves, provided adjacent to the eject opening and at an acute angle to a line along the direction of the connected nails substantially tangential with the surface of the fixed guide wall and guiding the sheet leaves in a direction of the discharge opening.

* * * * *